US009457593B2

(12) United States Patent
Ishida et al.

(10) Patent No.: US 9,457,593 B2
(45) Date of Patent: Oct. 4, 2016

(54) LIQUID EJECTING HEAD, RECORDING APPARATUS, AND RECORDING METHOD

(71) Applicant: CANON KABUSHIKI KAISHA, Tokyo (JP)

(72) Inventors: Koichi Ishida, Tokyo (JP); Ken Tsuchii, Sagamihara (JP); Nobuhito Yamaguchi, Inagi (JP); Hiroshi Arimizu, Kawasaki (JP); Yumi Komamiya, Kawasaki (JP); Arihito Miyakoshi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/056,919

(22) Filed: Feb. 29, 2016

(65) Prior Publication Data

US 2016/0257139 A1 Sep. 8, 2016

(30) Foreign Application Priority Data

Mar. 3, 2015 (JP) ..... 2015-041744

(51) Int. Cl.
*B41J 11/00* (2006.01)

(52) U.S. Cl.
CPC ..... *B41J 11/0015* (2013.01)

(58) Field of Classification Search
CPC .. B41J 11/0015; B41J 2/01; B41J 2002/032; B41J 2002/031; B41J 2/105; B41J 2/09; B41J 2/075; B41M 1/34
See application file for complete search history.

(56) References Cited

U.S. PATENT DOCUMENTS 5,528,271 A * 6/1996 Ebisawa ..... B41J 11/002 347/102
6,220,693 B1 * 4/2001 Bode ..... B41J 2/04516 347/34
6,997,538 B1 2/2006 Kawamura
8,459,775 B2 * 6/2013 Kaieda ..... B41J 2/165 347/77

* cited by examiner

*Primary Examiner* — Kristal Feggins
(74) *Attorney, Agent, or Firm* — Canon U.S.A. Inc., IP Division

(57) ABSTRACT

A liquid ejecting head ejects liquid from a plurality of ejection orifices thereof for recording while being moved relative to a recording medium. The liquid ejecting head includes a gas discharge port configured to allow gas to be discharged therefrom. The gas discharge port is disposed on a downstream side of the ejection orifices in a direction of relative movement of the recording medium as viewed from the liquid ejecting head. The gas discharged from the gas discharge port joins an airflow that forms a vortex on an upstream side of the ejection orifices in the direction of relative movement. The vortex is generated by the liquid ejected from the ejection orifices.

13 Claims, 9 Drawing Sheets

LIQUID EJECTING HEAD, RECORDING APPARATUS, AND RECORDING METHOD

BACKGROUND OF THE INVENTION

1. Field of the Invention

The present invention relates to a liquid ejecting head that ejects liquid, a recording apparatus that performs recording on a recording medium using the liquid ejecting head, and a recording method that performs recording using the liquid ejecting head and the recording apparatus.

2. Description of the Related Art

In recent years, inkjet recording apparatuses that perform recording by ejecting droplets from ejection orifices of a recording head have become widespread rapidly. In such an inkjet recording apparatus, an interference between an airflow generated by ejection of droplets onto a recording medium and an airflow generated by relative motion between a recording head and the recording medium tends to cause a vortex in front of an ejection orifice row in the scanning direction (see FIG. 10). Such airflows are known to affect the quality of a recorded image. In particular, ink droplets (hereinafter referred to as "satellite droplets") accompanying main ink droplets and having smaller diameters than the main ink droplets are more significantly affected by the airflows described above. As a solution to the problems described above, U.S. Pat. No. 6,997,538 discloses an inkjet recording method and an inkjet recording apparatus.

FIG. 12 illustrates a configuration of a recording head applied to the inkjet recording apparatus disclosed in U.S. Pat. No. 6,997,538. During recording, the inkjet recording apparatus discharges gas to cause an airflow between the recording head and a recording medium to flow parallel to the recording medium. The inkjet recording apparatus strongly discharges the gas to blow away the vortex described above, thereby reducing the effect of the airflow.

However, this technique requires a relatively large amount of gas to be discharged into a space between the recording head and the recording medium. As a result, discharging the gas may increase the amount of deviation in the landing positions of droplets ejected from ejection orifices.

In the inkjet recording apparatus, the ejection orifices may be densely formed in the recording head to improve the quality of a recorded image. Also, to achieve high-speed recording, the ejection frequency for the recording may be set to a relatively high value.

SUMMARY OF THE INVENTION

A liquid ejecting head ejects liquid from a plurality of ejection orifices thereof for recording while being moved relative to a recording medium. The liquid ejecting head includes a gas discharge port configured to allow gas to be discharged therefrom. The gas discharge port is disposed on a downstream side of the ejection orifices in a direction of relative movement of the recording medium as viewed from the liquid ejecting head. The gas discharged from the gas discharge port joins an airflow that forms a vortex on an upstream side of the ejection orifices in the direction of relative movement. The vortex is generated by the liquid ejected from the ejection orifices.

Further features of the present invention will become apparent from the following description of exemplary embodiments with reference to the attached drawings.

DESCRIPTION OF THE EMBODIMENTS

Figure 11:
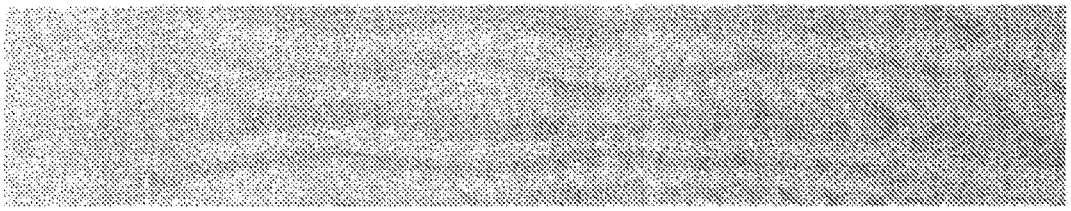
FIG. 11 shows, as a comparative example, a recorded image with wind ripples formed when recording is performed with a recording head.
Figure 12:
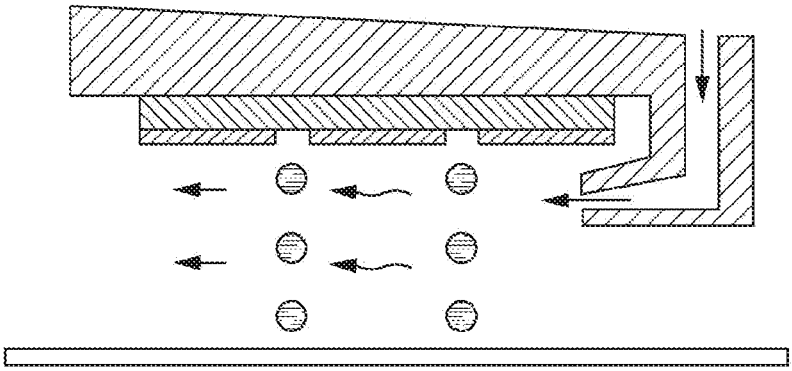
FIG. 12 is a diagram illustrating a state where gas is discharged to a space between a recording head according to another example of related art and a recording medium during recording performed with the recording head.

The present inventors have found out that when ejection orifices are densely formed in the recording head or when the ejection frequency is set to a relatively high value, a vortex formed between the recording head and the recording medium may become unstable. The present inventors have also found out that the unstable vortex may disrupt the landing positions of satellite droplets, cause formation of a streaky pattern (see FIG. 11) or irregularities such as wind ripples in sand dunes (hereinafter referred to as "wind ripples") in a recorded image, and degrade the image quality.

The present invention has been made in view of the circumstances described above. The present invention provides a liquid ejecting head, an inkjet recording apparatus, and an inkjet recording method that stabilize a vortex between the liquid ejecting head and the recording medium with a small amount of discharged gas, thereby reducing the amount of deviation in the landing positions of ink droplets.

Embodiments of the present invention will now be described with reference to the drawings.

First Embodiment

Figure 1:
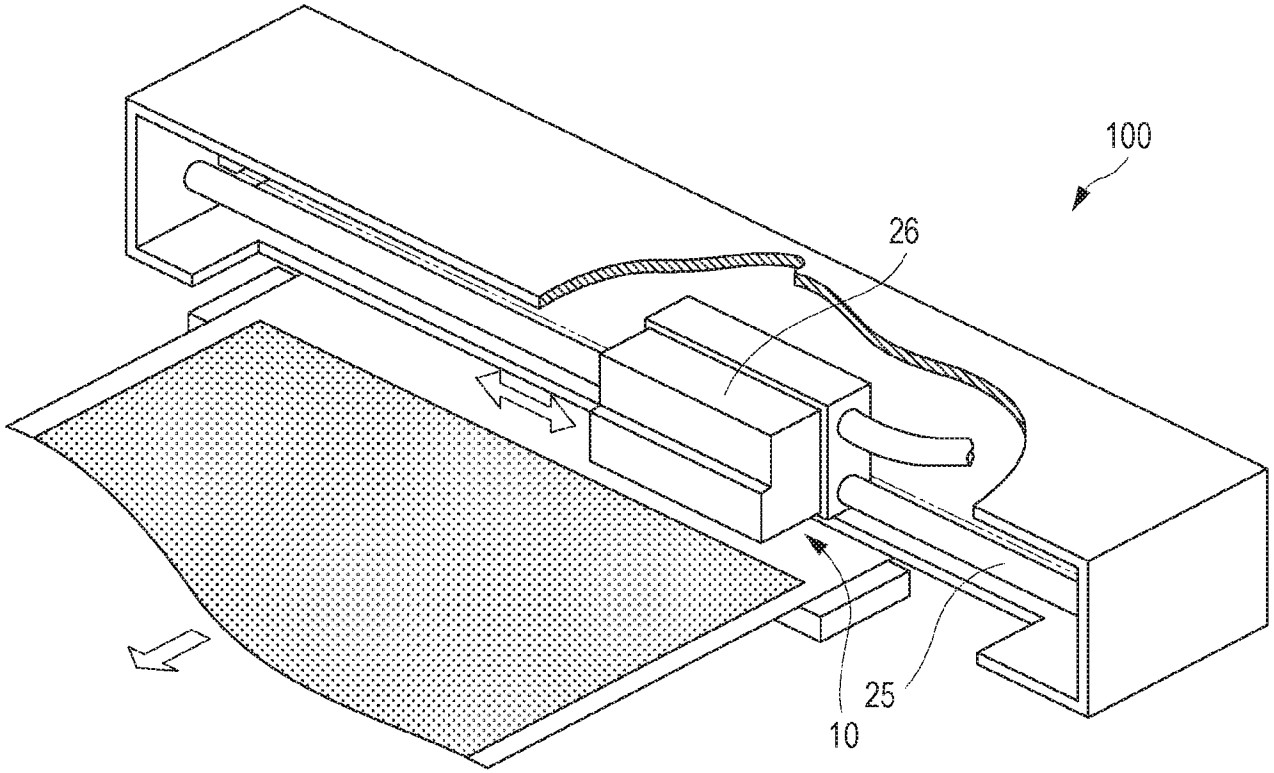
FIG. 1 is a cutaway perspective view schematically illustrating an outer appearance of a recording apparatus including a recording head according to a first embodiment of the present invention.

FIG. 1 illustrates an inkjet recording apparatus (recording apparatus) 100 including a liquid ejecting head (recording head) 10 according to a first embodiment of the present invention. The recording apparatus 100 of the first embodiment that ejects liquid, such as ink, is of a serial scanning type. As illustrated, a carriage 26 is guided by a guide shaft 25 such that it can freely move in the main scanning direction. The recording head 10 on the carriage 26 is mounted in the recording apparatus 100 such that it can move relative to the recording medium. The carriage 26 is reciprocated in the main scanning direction by driving force transmission mechanisms (not shown), such as a carriage motor and a belt for transmitting the driving force of the carriage motor. While moving the recording head 10 in the main scanning direction, the recording apparatus 100 performs recording by repeating a recording operation of ejecting ink toward a recording region in the recording medium and a conveying operation of conveying the recording medium in the sub-scanning direction by a distance corresponding to the recording width. With a conveying mechanism, such as a feed roller (not shown), the recording apparatus 100 conveys the recording medium in the conveying direction that crosses the main scanning direction of the recording head 10.

Figure 2A:
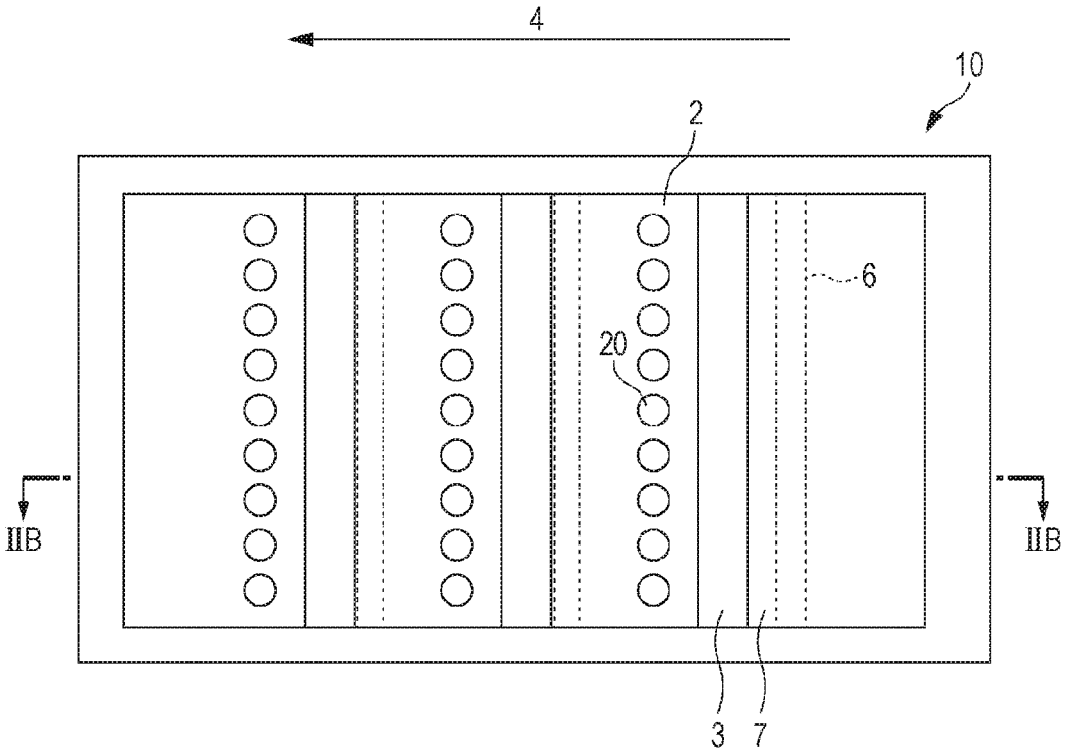
FIG. 2A is a plan view of the recording head included in the recording apparatus of FIG. 1, as viewed from a recording medium side.
Figure 2B:
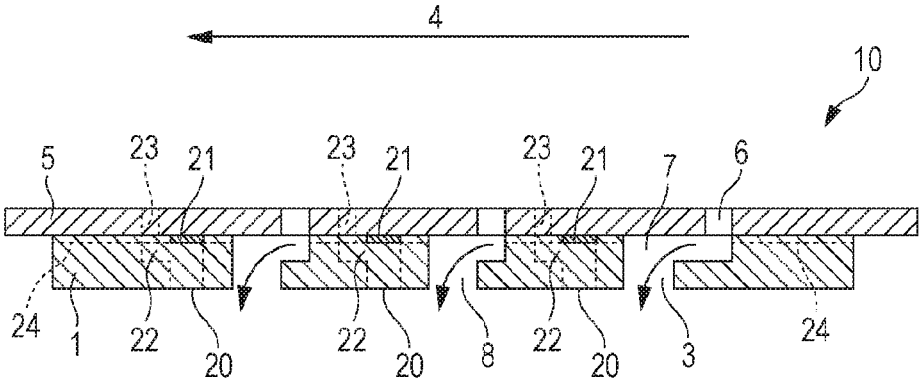
FIG. 2B is a cross-sectional view taken along line IIB-IIB of FIG. 2A.

FIGS. 2A and 2B illustrate the recording head 10 included in the recording apparatus 100 of FIG. 1. Specifically, FIG. 2A is a plan view illustrating the recording head 10 of the first embodiment as viewed from the recording medium side, and FIG. 2B is a cross-sectional view taken along line IIB-IIB of FIG. 2A. The recording head 10 is formed by bonding an orifice substrate 1 to an element substrate 24 on a support member 5. The orifice substrate 1 has a plurality of ejection orifice rows 2. In the first embodiment, the orifice substrate 1 has three ejection orifice rows 2. Ejection orifices 20 formed in the orifice substrate 1 to form the ejection orifice rows 2 communicate with a corresponding one of in-substrate ink passages 22 communicating with an ink passage from an ink tank (not shown). The ejection orifices 20 are configured to allow ink temporarily stored in the ink tank (not shown) to be ejected from the recording head 10. Each in-substrate ink passage 22 in the orifice substrate 1 is provided with a recording element 21, such as a heater or a piezoelectric element, disposed on the element substrate 24. The recording element 21 is configured to apply energy to ink for ejection of droplets. The ink tank may be either mounted on the recording head 10 or included in the main body of the recording apparatus 100.

The support member 5 has ink supply ports 23 configured to communicate with the respective in-substrate ink passages 22 communicating with corresponding ejection orifices 20 in the orifice substrate 1. Ink supplied to each ink supply port 23 is temporarily accumulated in the corresponding in-substrate ink passage 22. Then, current is applied through the element substrate 24 to the corresponding recording element 21 to generate thermal energy in the recording element 21, so that the ink in the in-substrate ink passage 22 is heated and bubbles are generated by film boiling. By the bubble generating energy, ink droplets are ejected from the ejection orifices 20.

As illustrated in FIGS. 2A and 2B, the orifice substrate 1 of the recording head 10 according to the first embodiment has gas discharge ports 3 that are open and extend parallel to the ejection orifice rows 2. Each gas discharge port 3 is formed behind the corresponding ejection orifice row 2 in a scanning direction 4 of the recording head 10. The gas discharge ports 3 may be formed to be longer than at least the ejection orifice rows 2, along the direction in which the ejection orifice rows 2 extend. The support member 5 of the recording head 10 has gas supply ports 6, which communicate with the respective gas discharge ports 3 to allow discharge gas to pass through respective gas passages 7.

With the passages configured to allow the discharge gas to pass therethrough, gas supplied from the gas supply ports 6 can be discharged toward the space between the recording head 10 and the recording medium. The passages for discharging the discharge gas are each formed in a crank shape by connecting the gas supply port 6 extending in the vertical direction, the gas passage 7 extending in the horizontal direction, and the gas discharge port 3 extending in the vertical direction. The discharge gas, which is eventually discharged through the gas discharge ports 3 extending in the vertical direction, is considered to be discharged in the vertical direction. In the recording head 10 of the first embodiment, however, the orifice substrate 1 is thin in thickness. Therefore, even though the discharge gas discharged from each gas discharge port 3 has a velocity component in the vertical direction along which the gas discharge port 3 extends, it does not lose a velocity component in the horizontal direction along which the gas passage 7 extends. Thus, as indicated by an arrow 8 (see FIG. 2B) showing the flow of gas, the gas having both a component in the vertical direction and a component in the scanning direction 4 of the recording head 10 is obliquely discharged.

Figure 3:
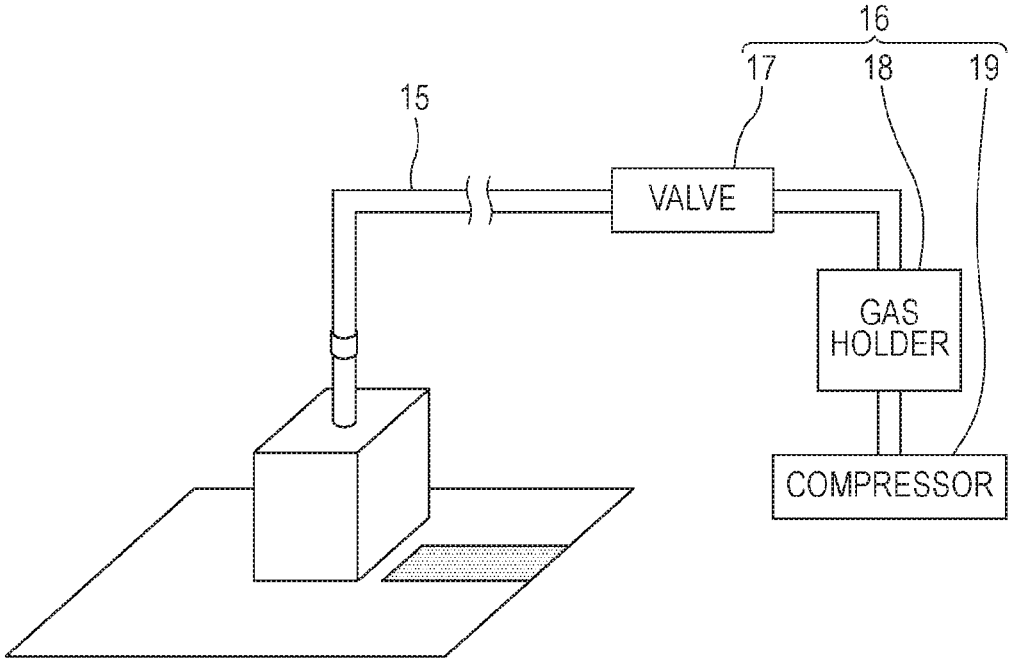
FIG. 3 is a diagram illustrating a configuration of a gas supply device that supplies gas to the recording head in the recording apparatus illustrated in FIG. 1.

With reference to FIG. 3, a configuration of a gas supply device 16 that supplies air (gas) to the gas discharge ports 3 will be described. The gas discharge ports 3 are connected to the gas supply device 16 through a gas supply hose 15 connected to the recording head 10. For stable supply of gas to the gas discharge ports 3 at a desired flow rate, the gas supply device 16 includes a compressor 19, a gas holder 18, and a valve 17. In the first embodiment, the gas supply device 16 is attached to the main body of the recording apparatus 100. However, the present invention is not limited to this. For example, the gas supply device 16 may be attached to the recording head 10. Alternatively, a separate gas supply device disposed outside the recording apparatus 100 may supply the discharge gas to the recording head 10.

Figure 4A:
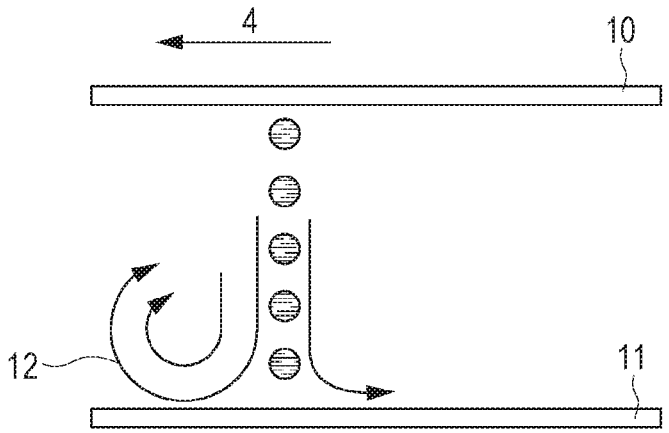
FIG. 4A is a diagram illustrating how air flows when no gas is discharged to a space between the recording head and the recording medium in the recording apparatus illustrated in FIG. 1.

An ejecting operation that involves ejecting droplets while the discharge gas is being discharged from the gas discharge ports 3 will now be described. FIG. 4A is a diagram illustrating how air flows in the space between the recording head 10 and a recording medium 11 when droplets are ejected from the ejection orifices 20 without discharge of gas, during the scanning operation of the recording head 10. In the space between the recording head 10 and the recording medium 11, droplets travel toward the recording medium 11 while pulling the surrounding air, thereby generating a vertical downward airflow. The vertical downward airflow collides with the recording medium 11 and reflects therefrom to form an upward airflow. During recording, the recording head 10 moves relative to the recording medium 11 through conveying the recording medium 11 or through the scanning operation of the recording head 10, thereby generating an airflow parallel to the recording medium 11 in the space between the recording head 10 and the recording medium 11. The airflow formed in the downward vertical direction by being temporarily pulled by droplets reflects off the recording medium 11, rolls up, and then meets a horizontal airflow generated by relative motion between the recording head 10 and the recording medium 11. As a result, a vortex is generated in front of the ejection orifice row 2 in the scanning direction 4 of the recording head 10. Thus, a horizontal airflow parallel to the recording medium 11 generated by the relative motion between the recording head 10 and the recording medium 11 and a vertical airflow generated by ejection of droplets form a cylindrical vortex 12 in front of the ejection orifice row 2 in the scanning direction 4.

The vortex 12 illustrated in FIG. 4A tends to be in a relatively unstable state when no gas is discharged from the gas discharge port 3. Since the airflows described above may cause deviation of the landing positions of ejected droplets, the quality of an image obtained by recording may be degraded.

Figure 4B:
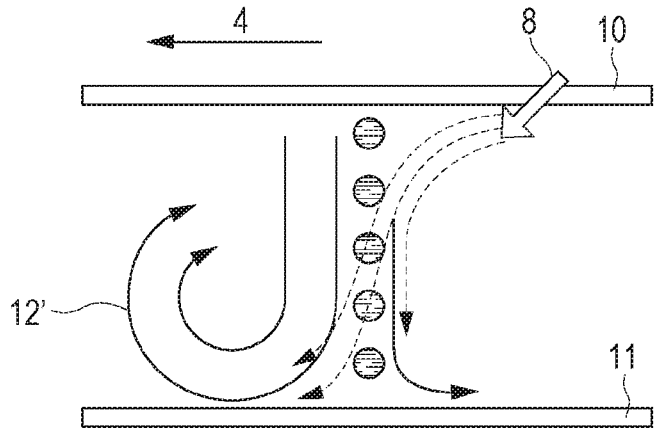
FIG. 4B is a diagram illustrating how air flows when gas is discharged to the space between the recording head and the recording medium.

However, when recording is performed with the recording head 10 of the first embodiment, gas can be discharged from the gas discharge ports 3 during ejection of droplets. When gas is discharged, during ejection of droplets, toward an airflow forming a vortex 12' (see FIG. 4B) generated in front of the ejection orifice row 2 in the scanning direction 4 of the recording head 10, the discharged gas joins the airflow forming the vortex 12'. Thus, since the vortex 12' is enlarged and stabilized as illustrated in FIG. 4B, it is possible to reduce deviation in the landing positions of droplets, and thus to obtain a high-quality recorded image.

When gas is discharged, the vortex 12' generated in front of ejected ink droplets in the scanning direction 4 is enlarged, and the center of the vortex 12' is eventually moved away from the ejection orifices 20. That is, when the recording head 10 performs scanning, the discharge gas is discharged from each gas discharge port 3 so that the center of the vortex 12' generated in front of the ink droplets ejected from the ejection orifices 20 in the direction of relative movement is moved away from the ejection orifices 20 in the scanning direction 4. Enlarging the vortex 12' increases the core radius of the vortex 12'. That is, during movement of the recording head 10 relative to the recording medium 11, the discharge gas is discharged to increase the core radius of the vortex 12' generated in front of liquid ejected from the ejection orifices 20 in the scanning direction 4.

Gas is discharged toward an airflow forming the vortex 12'. Specifically, of vertical downward airflows formed by ejection of droplets, a vertical downward airflow formed in front of the droplets in the scanning direction 4 is the airflow toward which the gas is discharged. The discharged gas thus passes between the ejected droplets to join the vertical downward airflow. If the flow rate of the discharged gas is too high in this case, the landing positions of the ejected droplets are affected and this affects the quality of the recorded image. Therefore, the flow rate of discharged gas may need to be a level that does not affect the landing positions of ejected droplets, but allows the discharged gas to pass between the ejected droplets and reach the airflow forming the vortex 12'.

If the velocity of discharge gas or the velocity of a stream formed when the discharge gas joins the airflow forming the vortex is too high, the resulting flow of air may become turbulent. The turbulent flow of air is unstable and this is known to degrade the landing accuracy of ejected droplets. Therefore, the discharged gas is required to flow at a velocity that can maintain a laminar flow of air and does not cause turbulence when the gas joins the airflow forming the vortex. It is thus possible to stabilize the shape of the vortex and reduce the amount of deviation in the landing positions of ejected droplets. This can eventually reduce degradation in the quality of the recorded image.

The effect achieved by discharging gas will now be described, using a concrete example, by comparing the distributions of landing positions of satellite droplets. In the inkjet recording apparatus used here, the distance between the recording head and the recording medium is 1.25 mm, and the velocity of the recording head during scanning is 0.635 m/s. As for the configuration of ejection orifice rows, the volume of each ejected droplet is about 1 pl, the number of ejection orifices in each ejection orifice row is 256, the pitch of the ejection orifices is 42.4 μm, and the ejection frequency is 15 KHz.

In the case of the recording head from which no gas is discharged, the actual landing positions of ejected satellite droplets deviate by up to about ±15 μm from predetermined estimated landing positions in the direction of ejection orifice rows.

The distribution of landing positions obtained in the case of using the recording head 10 from which gas is discharged will now be described. In this case, gas is discharged at an angle of 15° toward the ejection orifices 20 from a line vertically extending from the surface of the orifice substrate 1 of the recording head 10 having the ejection orifices 20. The discharge conditions here are that the discharge velocity is about 10 m/s at a position 500 μm behind each ejection orifice row 2, and the width of the gas discharge port 3 orthogonal to the direction in which the ejection orifice row 2 extends is 20 μm. In this case, the landing positions of satellite droplets deviate by not more than about ±5 μm from predetermined landing positions. It is thus possible to suppress the occurrence of wind ripples.

The flow rate of discharge gas required to achieve the above-described effect will now be described. In the configuration of related art where an airflow in the space between the recording head and the recording medium is parallel to the recording medium, the velocity of the airflow in this space is about 2 m/s. When the distance between the recording head and the recording medium is 1.25 mm, the flow rate can be estimated from the length (about 11 mm) of the ejection orifice rows in the direction in which the ejection orifice rows extend. That is, under the discharge conditions described above, the flow rate of the airflow flowing in the space between the recording head and the recording medium is estimated to be about $27\times10^{-6}$ $m^3/s$.

When there is no discharge of gas and only an airflow formed by relative motion between the recording head and the recording medium flows in the space therebetween, the flow rate of the airflow estimated in the same manner as above is about $4\times10^{-6}$ $m^3/s$. Thus, when the discharging method of related art is used as described above, the flow rate of the airflow in the space between the recording head and the recording medium is much higher than the flow rate of the airflow caused to flow in the space between the recording head and the recording medium by the scanning operation of the recording head.

On the other hand, when the recording head 10 of the first embodiment obliquely discharges gas from behind each ejection orifice row 2 in the scanning direction 4, the vortex can be stabilized by discharging the gas at a relatively low flow rate. From the dimensions of the gas discharge port 3 and the flow velocity, the flow rate of the discharge in this case is estimated to be about $2\times10^{-6}$ $m^3/s$. This flow rate of the discharge is much lower than that in the case where the flow between the recording head and the recording medium is made parallel to the recording medium by the technique used in related art. The amount of discharge gas required here is smaller than the amount of air flowing in the space between the recording head and the recording medium when there is no discharge of gas as described above. Therefore, by discharging gas at a relatively low flow rate, it is possible to efficiently stabilize the vortex generated in front of each ejection orifice row 2 in the scanning direction 4. This can reduce deviation in the landing positions of droplets caused by an unstable vortex, and thus reduce degradation of the quality of an image obtained by recording. Since the amount of discharge gas can be reduced, it is possible to reduce the effect of discharged gas on droplets and to reliably reduce deviation in the landing positions of the droplets.

Also, since the flow rate of discharge can be reduced, it is possible to reduce the size of the structure of the gas supply device 16 attached to the main body of the recording apparatus 100 for discharge of gas. It is thus possible to reduce the cost of manufacture of the recording apparatus 100, and also to save the space for using the recording apparatus 100. Also, since the amount of power consumed for discharging gas can be reduced, the cost required to maintain the recording apparatus 100 can be reduced.

Figure 5A:
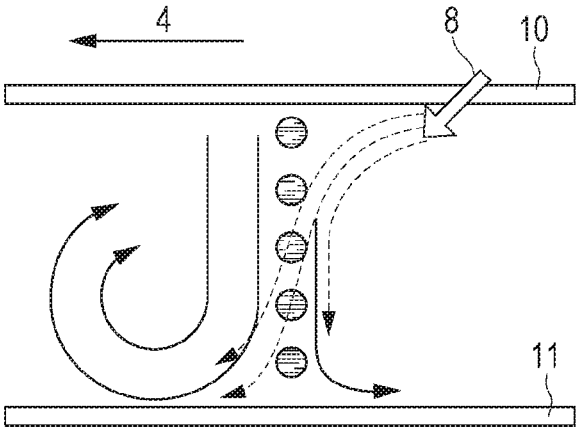
FIG. 5A is a diagram illustrating how air flows when gas discharged from a discharge port joins an airflow forming a vortex.
Figure 5B:
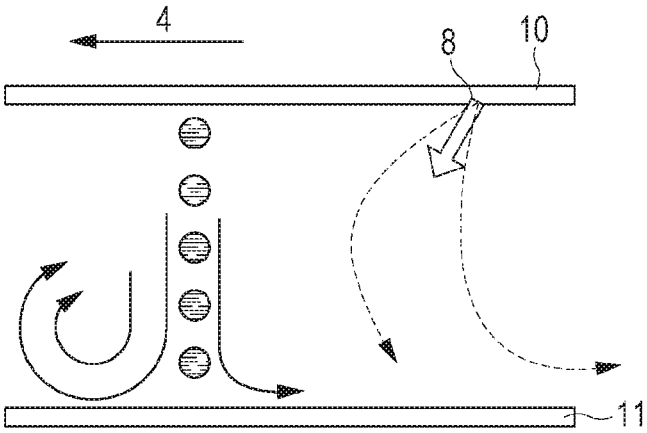
FIG. 5B is a diagram illustrating how air flows when the discharged gas does not reach the airflow forming the vortex.

Desirable discharge conditions will now be described. To reduce deviation in the landing positions of ejected droplets by discharging gas, it is necessary, as illustrated in FIG. 5A, that gas discharged from behind the ejection orifice row 2 in the scanning direction 4 join the vortex formed in front of the ejection orifice row 2 in the scanning direction 4, and that the vortex be enlarged. As illustrated in FIG. 5B, if gas discharged from the gas discharge port 3 does not reach the vortex formed in front of the ejection orifice row 2 in the scanning direction 4, the airflow between the recording head 10 and the recording medium 11 cannot be stabilized. Hence, the amount of deviation in the landing positions of droplets during recording cannot be reduced.

Figure 5C:
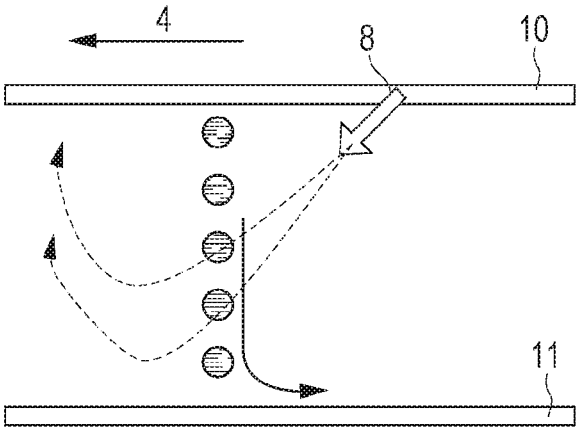
FIG. 5C is a diagram illustrating how air flows when the discharged gas destroys the vortex.

In the case of FIG. 5C where gas discharged at an excessive flow rate from the gas discharge port 3 passes between ejected droplets and destroys the vortex, it is not possible to reduce deviation in the landing positions of droplets. Therefore, the flow rate of gas discharged from the gas discharge port 3 is required to be higher than or equal to a level that allows the gas to reach the airflow formed by ejection of ink droplets and lower than a level that allows the gas to destroy the vortex. It is thus necessary to set the discharge conditions such that the gas discharged from the gas discharge port 3 can join the airflow forming the vortex generated in front of the ejection orifice row 2 in the scanning direction 4. Specifically, it is necessary to set the distance between the ejection orifices 20 and the gas discharge port 3, the flow rate of discharge, and the angle of discharge such that the discharged gas joins the airflow forming the vortex.

Figure 6A:
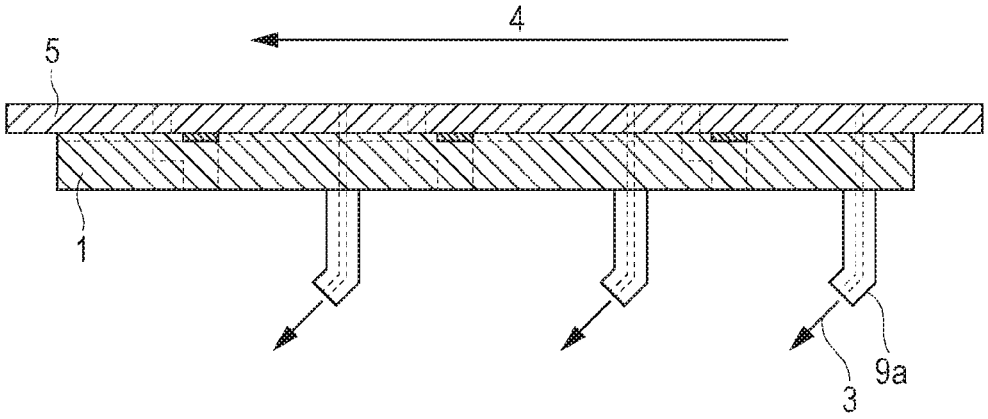
FIGS. 6A and 6B are each a cross-sectional view of a recording head provided with discharge ducts for discharging gas according to another embodiment.
Figure 6B:
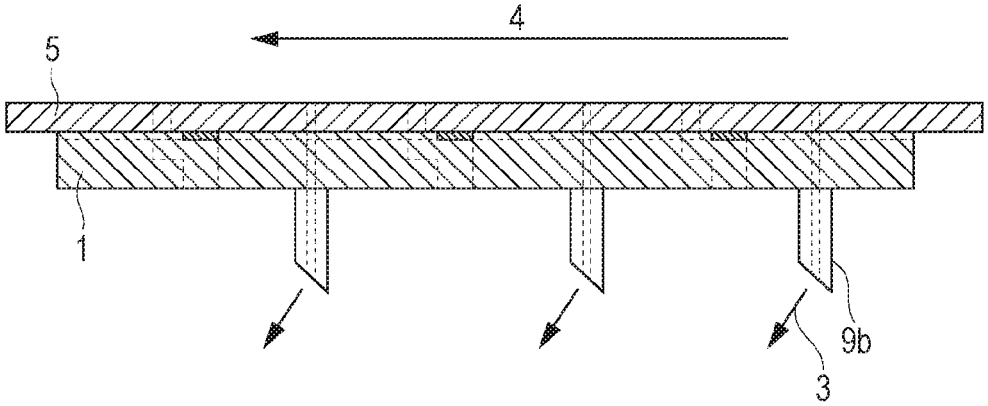

In the first embodiment described above, the gas is discharged from the gas discharge ports 3 in the orifice substrate 1. However, the configuration used to discharge the gas is not limited to this. As illustrated in FIGS. 6A and 6B, the orifice substrate 1 may be provided with discharge ducts 9*a* or 9*b* so that the gas can be obliquely discharged from backward to forward in the scanning direction 4 of the recording head 10. The discharge ducts 9*a* and 9*b* each have an internal gas passage through which discharge gas can flow, and have the gas discharge port 3 opening at an end thereof for discharging the discharge gas. Using the discharge ducts 9*a* or 9*b* facilitates adjustment of the angle at which the discharge gas is discharged. Thus, the discharge gas can be discharged at an angle suitable for stabilizing the airflow between the recording head 10 and the recording medium 11. Also, through the discharge ducts 9*a* or 9*b*, the discharge gas can be discharged forward from a position distant from the surface of the orifice substrate 1. With such gas passages, the discharge gas can be discharged from a position closer to the vortex. This makes it possible to stabilize the airflow between the recording head 10 and the recording medium 11 with a smaller amount of discharge gas. As long as desired gas can be stably supplied at a desired flow rate, any form, number, and configuration of gas supply devices may be used.

Second Embodiment

A second embodiment of the present invention will now be described with reference to FIG. 7. The same components as those in the first embodiment will be denoted by the same reference numerals to omit their description, and only differences from the first embodiment will be described.

Figure 7:
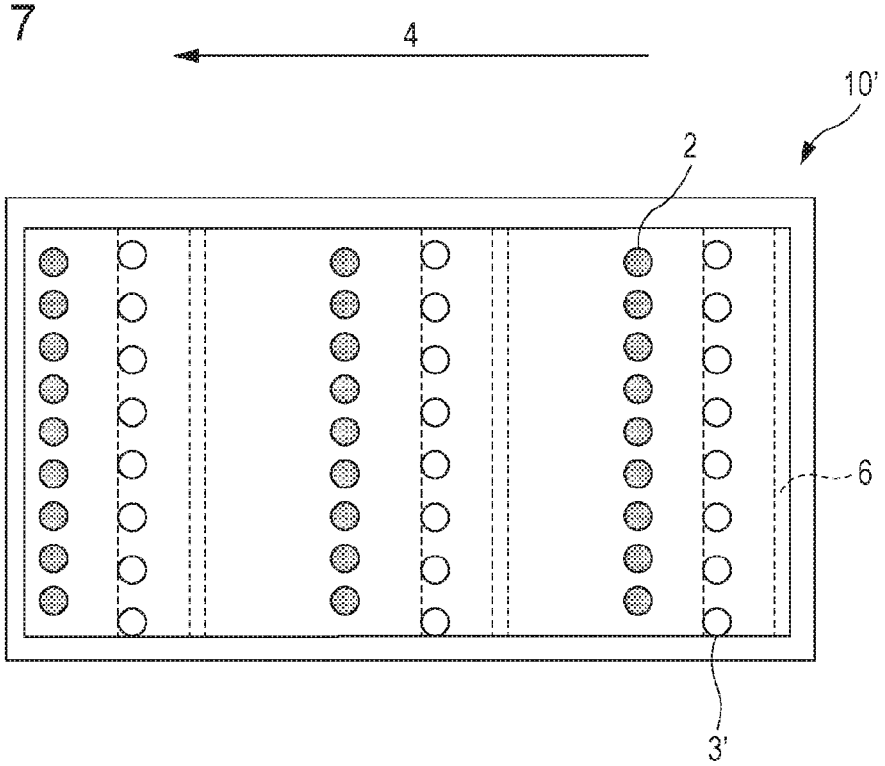
FIG. 7 is a plan view of a recording head according to a second embodiment of the present invention, as viewed from a recording medium side.

FIG. 7 is a plan view of a liquid ejecting head (recording head) 10' according to the second embodiment. In the recording head 10 of the first embodiment, each gas discharge port 3 is a slit-like continuous opening that extends along and throughout the length of the corresponding ejection orifice row 2. In the second embodiment, as illustrated in FIG. 7, a plurality of gas discharge ports 3', each of which is a circular opening, are arranged parallel to the length of the corresponding ejection orifice row 2. The total opening area obtained by adding up the opening areas of all the gas discharge ports 3' in the recording head 10' is smaller than that of the gas discharge ports 3 in the recording head 10 of the first embodiment. Since the total opening area of the gas discharge ports 3' in the recording head 10' is smaller, the flow velocity of discharge gas is higher than that in the first embodiment, given the same flow rate of discharge gas. It is thus possible to reduce the flow rate of discharge gas required for the discharge gas to reach the airflow forming the vortex. The gas discharge ports 3' do not necessarily need to be circular in shape, as long as the total opening area of the gas discharge ports 3' is smaller than that of the gas discharge ports 3 having a slit-like shape.

Third Embodiment

A third embodiment of the present invention will now be described with reference to FIG. 8. The same components as those in the first and second embodiments will be denoted by the same reference numerals to omit their description, and only differences from the first and second embodiments will be described.

Figure 8:
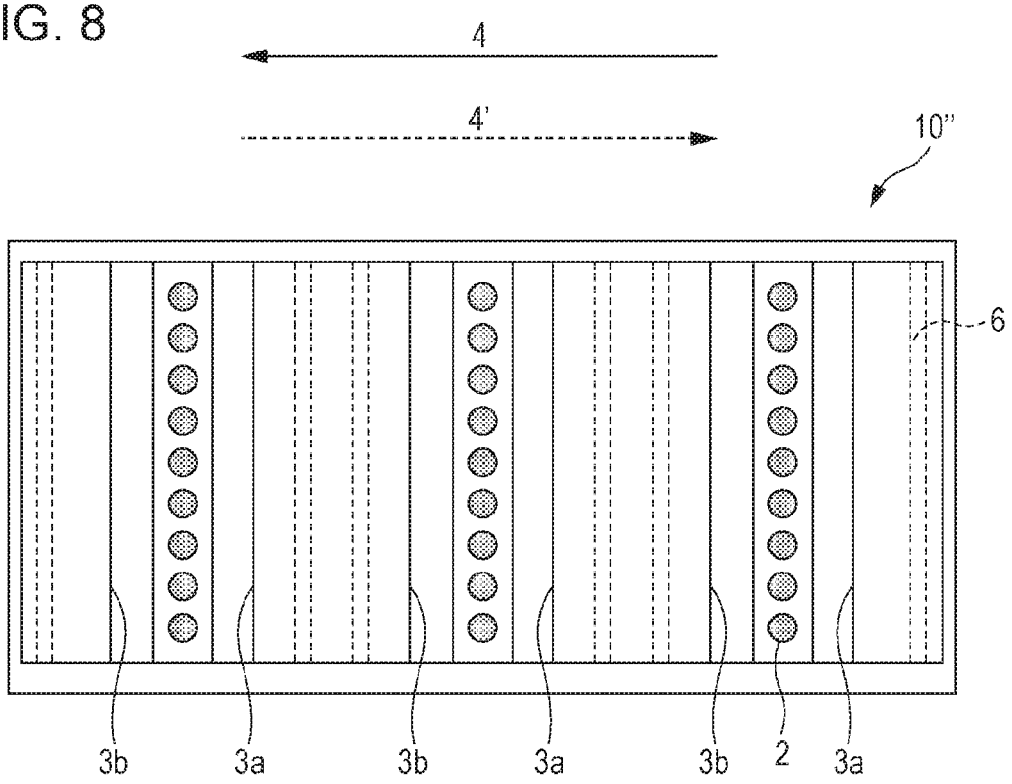
FIG. 8 is a plan view of a recording head according to a third embodiment of the present invention, as viewed from a recording medium side.

FIG. 8 is a plan view of a liquid ejecting head (recording head) 10" according to the third embodiment. In the first and second embodiments described above, the gas discharge ports for discharging gas are provided only behind the corresponding ejection orifice rows in the scanning direction of the recording head. In the third embodiment, the recording head 10" can perform relative movement by scanning in a reciprocating manner, and can perform recording during scanning in both forward and backward directions 4 and 4'. As illustrated in FIG. 8, for scanning in both the forward and backward directions 4 and 4', gas discharge ports 3*a* and 3*b* are formed on both sides of each ejection orifice row 2 in the scanning direction. Specifically, in the recording head 10", the gas discharge ports 3*a* are each formed such that it is located behind the corresponding ejection orifice row 2 during scanning in the forward direction 4, whereas the gas discharge ports 3*b* are each formed such that it is located behind the corresponding ejection orifice row 2 during scanning in the backward direction 4'. In the third embodiment, the gas discharge ports 3*a* and 3*b* for discharging gas have respective discharge passages independent of each other. The gas supply ports 6 communicating with the respective gas discharge ports 3*a* and 3*b* are provided with separate gas supply valves for independently supplying discharge gas to the gas discharge port 3*a* on one side of the ejection orifice row 2 and to the gas discharge port 3*b* on the other side of the ejection orifice row 2 in the scanning direction.

Figure 9A:
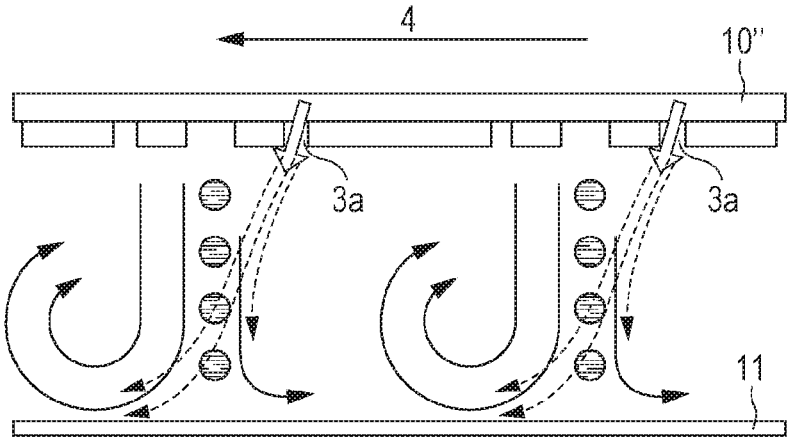
FIG. 9A is a diagram illustrating how air flows during a forward scanning operation of the recording head illustrated in FIG. 8.
Figure 9B:
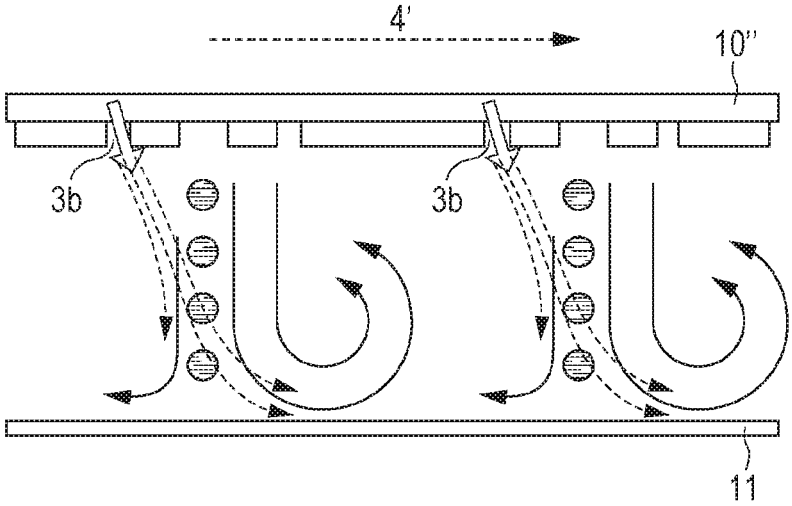
FIG. 9B is a diagram illustrating how air flows during a backward scanning operation of the recording head illustrated in FIG. 8.
Figure 10:
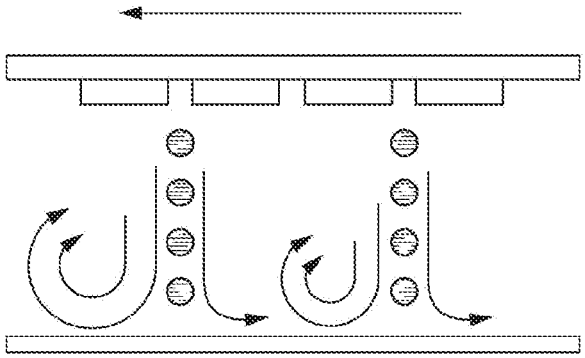
FIG. 10 is a diagram illustrating how air flows between a recording head of related art and a recording medium when droplets are ejected from the recording head.

FIGS. 9A and 9B are diagrams illustrating how gas is discharged and how air flows during the scanning operation of the recording head 10" in the forward and backward directions 4 and 4'. When the recording head 10" moves in the forward direction 4 as illustrated in FIG. 9A, the gas supply valves are operated to supply gas from the gas discharge ports 3*a* and to stop supply of gas from the gas discharge ports 3*b*. When the recording head 10" moves in the backward direction 4' as illustrated in FIG. 9B, the gas supply valves are operated to supply gas from the gas discharge ports 3*b* and to stop supply of gas from the gas discharge ports 3*a*. Operating the gas supply valves as described above allows the recording head 10" to support bidirectional recording. When the recording head 10" performs recording in both the forward and backward directions 4 and 4', gas that joins the airflow forming the vortex in front of each of the ejection orifice rows 2 in the scanning direction can be discharged from the gas discharge ports 3*a* and 3*b*. Therefore, even in high-speed recording, the image quality can be maintained at a high level.

OTHER EMBODIMENTS

Although the gas discharged from the gas discharge ports is air in the embodiments described above, the discharged gas may be humidified air. In this case, the discharged humidified air can not only stabilize the airflow by enlarging the vortex, but can also increase humidity in the vicinity of the ejection orifices. When the humidity in the vicinity of the ejection orifices increases, it is possible to reduce an increase in the viscosity of ink accumulated around the ejection orifices caused by drying. This makes it possible to maintain good ejection conditions of ink, and to reduce the situation where ink cannot be ejected due to an increased in its viscosity.

The discharged gas may be a cooling gas for cooling the interior of the recording head. In this case, the discharged cooling gas can not only stabilize the airflow by enlarging the vortex, but can also cool the interior of the recording head during flowing of the cooling gas through the gas passages. Therefore, it is possible to reduce an increase in the temperature of the recording head, and thus to reduce degradation of ink characteristics caused by an excessive increase in the temperature of the recording head.

The type of gas discharged from the gas discharge ports is not limited to those described above. Other types of gas may be used, as long as they can join the vortex generated in front thereof in the scanning direction and increase the size of the vortex.

In the embodiments described above, the recording apparatus is an inkjet recording apparatus of a serial scanning type that performs recording while scanning is being performed by the recording head. The embodiments described above deal with the case where the relative movement between the recording head and the recording medium takes place by the scanning operation of the recording head. However, the present invention is not limited to this. The present invention may be applied to the case where the relative movement between the recording head and the recording medium takes place by conveying the recording medium. In this case, the recording head may not be included in the inkjet recording apparatus of a serial scanning type, and the present invention may be applied to an inkjet recording apparatus of a full line type.

In the present invention described above, the airflow between the recording head and the recording medium can be efficiently stabilized by discharging gas, and hence the amount of gas discharged for stabilizing the airflow can be reduced. Therefore, it is possible to reduce the amount of deviation in the landing positions of droplets ejected for recording, and thus to improve the quality of the recorded image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-041744 filed Mar. 3, 2015, which is hereby incorporated by reference herein in its entirety.

What is claimed is:

1. A liquid ejecting head that ejects liquid from a plurality of ejection orifices thereof for recording while being moved relative to a recording medium, the liquid ejecting head comprising:

a gas discharge port configured to allow gas to be discharged therefrom, the gas discharge port being disposed on a downstream side of the ejection orifices in a direction of relative movement of the recording medium as viewed from the liquid ejecting head, wherein the gas discharged from the gas discharge port joins an airflow that forms a vortex on an upstream side of the ejection orifices in the direction of relative movement, the vortex being generated by the liquid ejected from the ejection orifices.

2. The liquid ejecting head according to claim 1, wherein the gas discharge port allows the gas to be discharged obliquely from the downstream side of the ejection orifices in the direction of relative movement toward the upstream side in the direction of relative movement.

3. The liquid ejecting head according to claim 1, wherein the gas is discharged at a flow rate higher than or equal to a level that allows the gas to reach an airflow generated by ejection of the liquid and lower than a level that destroys the vortex.

4. The liquid ejecting head according to claim 1, wherein the plurality of ejection orifices are arranged to form an ejection orifice row; and the gas discharge port is formed to be longer than the ejection orifice row along a direction in which the ejection orifice row extends.

5. The liquid ejecting head according to claim 1, wherein the gas discharge port is formed by a plurality of holes.

6. The liquid ejecting head according to claim 1, wherein the liquid ejecting head is capable of recording during relative movement in both a forward direction and a backward direction; and during movement in either the forward or backward direction, the gas discharge port is located on the downstream side of the ejection orifices in the direction of relative movement.

7. The liquid ejecting head according to claim 1, wherein the discharged gas is humidified air.

8. The liquid ejecting head according to claim 1, wherein the discharged gas is a cooling gas for cooling the liquid ejecting head.

9. A liquid ejecting head that ejects liquid from a plurality of ejection orifices thereof for recording while being moved relative to a recording medium, the liquid ejecting head comprising:

a gas discharge port configured to allow gas to be discharged therefrom, the gas discharge port being disposed on a downstream side of the ejection orifices in a direction of relative movement of the recording medium as viewed from the liquid ejecting head, wherein the gas is discharged from the gas discharge port to move a center of a vortex toward an upstream side of the ejection orifices in the direction of relative movement, the vortex being generated on the upstream side by the liquid ejected from the ejection orifices.

10. A liquid ejecting head that ejects liquid from a plurality of ejection orifices thereof for recording while being moved relative to a recording medium, the liquid ejecting head comprising:

a gas discharge port configured to allow gas to be discharged therefrom, the gas discharge port being disposed on a downstream side of the ejection orifices in a direction of relative movement of the recording medium as viewed from the liquid ejecting head, wherein the gas is discharged from the gas discharge port to increase a core radius of a vortex on an upstream side of the ejection orifices in the direction of relative movement, the vortex being generated by the liquid ejected from the ejection orifices.

11. An inkjet recording apparatus that performs recording, comprising:

a liquid ejecting head configured to eject liquid from a plurality of ejection orifices thereof for the recording while being moved by the inkjet recording apparatus relative to a recording medium, wherein the liquid ejecting head has a gas discharge port configured to allow gas to be discharged therefrom, the gas discharge port being disposed on a downstream side of the ejection orifices in a direction of relative movement of the recording medium as viewed from the liquid ejecting head; and the gas discharged from the gas discharge port joins an airflow that forms a vortex on an upstream side of the ejection orifices in the direction of relative movement, the vortex being generated by the liquid ejected from the ejection orifices.

12. The inkjet recording apparatus according to claim 11, wherein the liquid ejecting head is capable of being reciprocated and recording during scanning in both a forward direction and a backward direction;

the gas discharge port is located behind the ejection orifices in a direction of movement of the liquid ejecting head during scanning in either the forward or backward direction; and supplying gas to the gas discharge port located behind the ejection orifices in the direction of movement of the liquid ejecting head during scanning in the forward direction, and supplying gas to the gas discharge port located behind the ejection orifices in the direction of movement of the liquid ejecting head during scanning in the backward direction, are independently performed.

13. An inkjet recording method comprising:

recording by ejecting liquid from a plurality of ejection orifices of a liquid ejecting head while moving the liquid ejecting head relative to a recording medium, wherein when a vortex is generated on an upstream side of the ejection orifices in a direction of relative movement of the recording medium as viewed from the liquid ejecting head, the recording is performed while gas that can join an airflow forming the vortex is being discharged from a gas discharge port disposed on a downstream side of the ejection orifices in the direction of relative movement.

* * * * *